US010661942B2

(12) United States Patent
McCarthy

(10) Patent No.: US 10,661,942 B2
(45) Date of Patent: May 26, 2020

(54) CORRUGATED ACCORDION SHAPED INSERT FOR SHIPPING CONTAINER

(71) Applicant: WestRock Shared Services, LLC, Atlanta, GA (US)

(72) Inventor: Timothy L. McCarthy, Wilmette, IL (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/152,912

(22) Filed: Oct. 5, 2018

(65) Prior Publication Data

US 2020/0108971 A1 Apr. 9, 2020

(51) Int. Cl.
*B65D 5/50* (2006.01)

(52) U.S. Cl.
CPC ..... *B65D 5/5061* (2013.01)

(58) Field of Classification Search
USPC ..... 206/588, 589, 590
See application file for complete search history.

(56) References Cited

U.S. PATENT DOCUMENTS 1,021,998 A * 4/1912 Myers ..... B65D 85/20 206/443
1,353,629 A * 9/1920 Cibulka ..... B65D 5/106 206/486
1,674,209 A * 6/1928 Lord ..... B65D 5/5059 206/589
2,077,570 A * 4/1937 Lamare ..... B65D 5/00 229/125.37
2,256,995 A * 9/1941 Andres ..... B65D 5/5042 206/589
3,291,365 A * 12/1966 Koene ..... B65D 71/16 206/521.7
3,567,103 A * 3/1971 Seifert ..... B65D 5/5054 206/588
4,572,362 A * 2/1986 Kronfeld ..... B65D 85/42 206/418
4,600,101 A * 7/1986 Naia ..... B65D 5/5038 206/418
5,246,107 A * 9/1993 Long ..... G11B 33/045 206/308.1
5,813,523 A * 9/1998 Gnadt ..... B65D 5/4204 206/590
10,238,157 B2 * 3/2019 Nordstrom ..... A41D 13/002

* cited by examiner

*Primary Examiner* — Jacob K Ackun
(74) *Attorney, Agent, or Firm* — WestRock IP Legal

(57) ABSTRACT

A corrugated insert for supporting products within a shipping container is disclosed, which includes a plurality of rectangular panels foldably connected to one another along longitudinally extending edges thereof in such a manner so as to form an accordion configuration that includes an upper panel, a lower panel and a plurality of medial panels, each medial panel having a set of longitudinally spaced apart apertures formed therein, wherein the apertures on each medial panel are aligned with the apertures formed in an adjacent medial panel when the medial panels are in the accordion configuration for receiving supporting the products within the shipping container.

7 Claims, 4 Drawing Sheets

CORRUGATED ACCORDION SHAPED INSERT FOR SHIPPING CONTAINER

BACKGROUND OF THE INVENTION

1. Field of the Invention

The subject invention is directed to packaging, and more particularly, to a corrugated accordion shaped insert for supporting and protecting a plurality of products in a shipping container.

2. Description of Related Art

It is known to package and ship fragile products such as glassware and pottery for retail sale in shipping containers or cartons using protective cushioning materials such as tissue paper, craft paper, packing peanuts, air-filled packing pillows, foam wrap and bubble wrap. These types of cushioning materials are relatively costly, they are often difficult to use and some are not readily biodegradable. They also do not provide an aesthetically pleasing way to display or otherwise present the products within the shipping container in a manner that is suitable for retail sale.

It would be beneficial therefore to provide a more convenient, cost effective and aesthetically pleasing way to package fragile products such as glassware and pottery for shipping and retail display within a shipping container, without the need for common cushioning material.

The subject invention provides such a solution in the form of a corrugated accordion shaped insert for supporting and protecting a plurality of fragile products within a shipping container.

SUMMARY OF THE DISCLOSURE

The subject invention is directed to a new and useful insert for supporting and protecting fragile products within a shipping container. For example, the insert of the subject invention is well suited for shipping fragile glassware or pottery, and it is particularly adapted and configured for accommodating products that have a tapered cylindrical shape.

The insert includes a plurality of panels which are foldably connected to one another along longitudinally extending edges. More particularly, the panels of the insert are foldably connected to one another in such a manner so as to form an accordion configuration that includes an upper panel, a lower panel and a plurality of medial panels. Preferably, the insert is constructed from a plurality of rectangular panels. However, it envisioned and well within the scope of the subject disclosure that the insert may be constructed from a plurality of square panels.

Each medial panel of the insert has at least one aperture formed therein, and preferably, each medial panel of the insert has a set of longitudinally spaced apart apertures formed therein, wherein the apertures formed in each medial panel are aligned with the apertures formed in an adjacent medial panel when the medial panels are in the accordion configuration so as to receive and support the products within the shipping container.

Preferably, the insert is formed from a die cut blank of corrugated cardboard material having corrugations that run either perpendicular or horizontally to the longitudinal edges of the panels. Those skilled in the art will readily appreciate that the size of the panels may vary depending upon the number and size of the products, providing adequate containment, and cushioning, that are supported within the shipping container, or to facilitate a minimal shipping container size.

In a preferred embodiment of the subject invention, the plurality of medial panels of the insert includes first, second and third medial panels, and each medial panel may include a single, or multiple circular apertures. Preferably, each aperture in the first medial panel has a diameter that is greater or equal to the diameter of each aperture in the second medial panel, and each aperture in the second medial panel has a diameter that is equal to or greater than a diameter of each aperture in the third medial panel. The upper panel of the insert may include an engagement notch formed in an outer longitudinal edge thereof to lift the upper panel away from the products supported by the insert.

When the insert is located with the shipping container and the top and bottom flaps of the container are closed, the upper panel of the insert will be in surface-to-surface planar contact with the top flaps of the shipping container, and the lower panel of the insert will be in surface-to-surface planar contact with the bottom flaps of the shipping container. At such a time, the angled medial panels in their accordion configuration will provide a cushion curve on impact, reducing damage to the products supported therein.

These and other features of the corrugated accordion shaped packaging insert of the subject invention will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those skilled in the art will readily understand how to make and use the accordion shaped insert of the subject invention without undue experimentation, preferred embodiments thereof will be described in detail herein below with reference to the figures wherein.

DETAILED DESCRIPTION OF THE PREFERRED EMBODIMENTS

Figure 1:
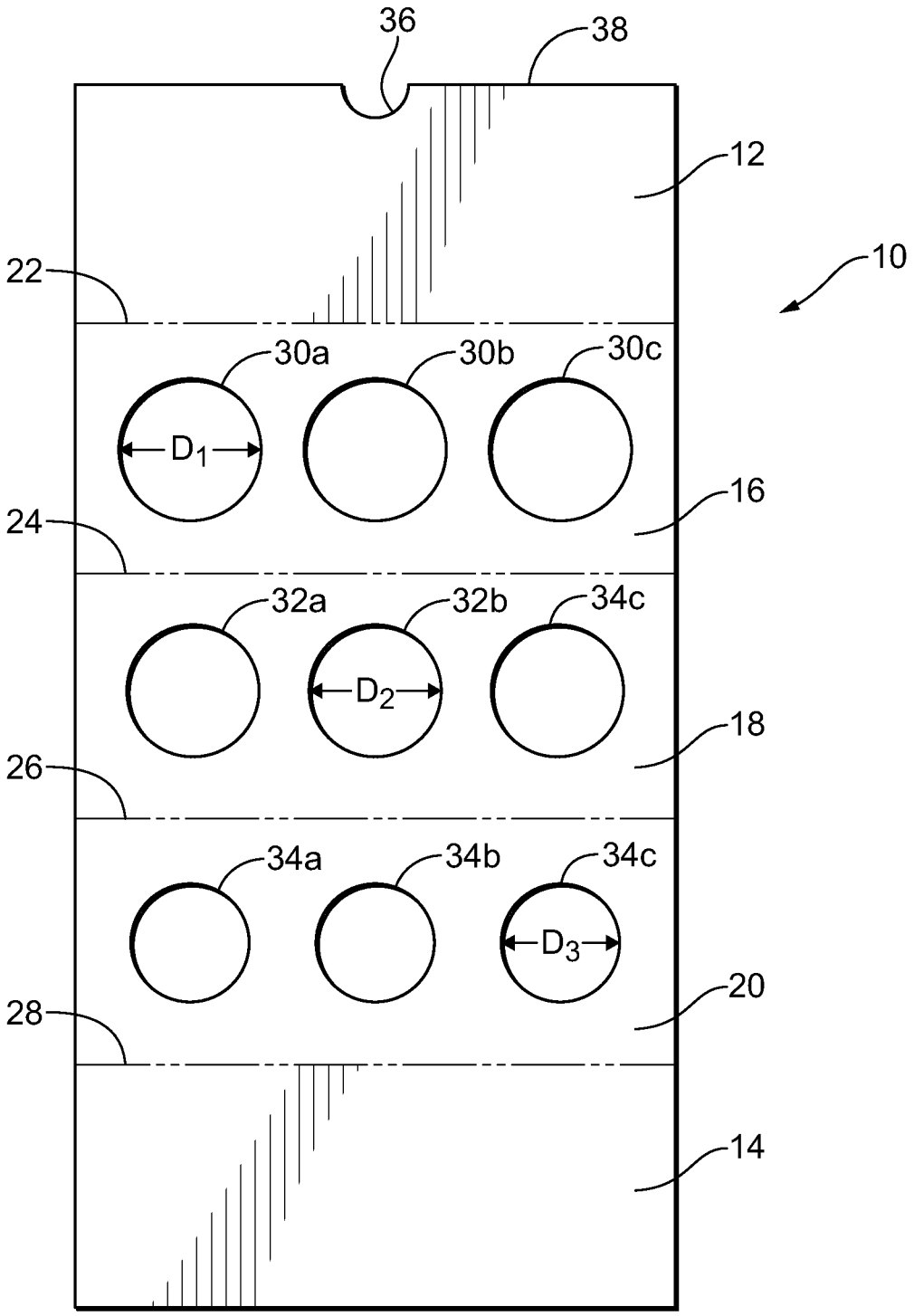
FIG. 1 is a top plan view of a die cut blank for erecting the corrugated accordion shaped insert of the subject invention.
Figure 2:
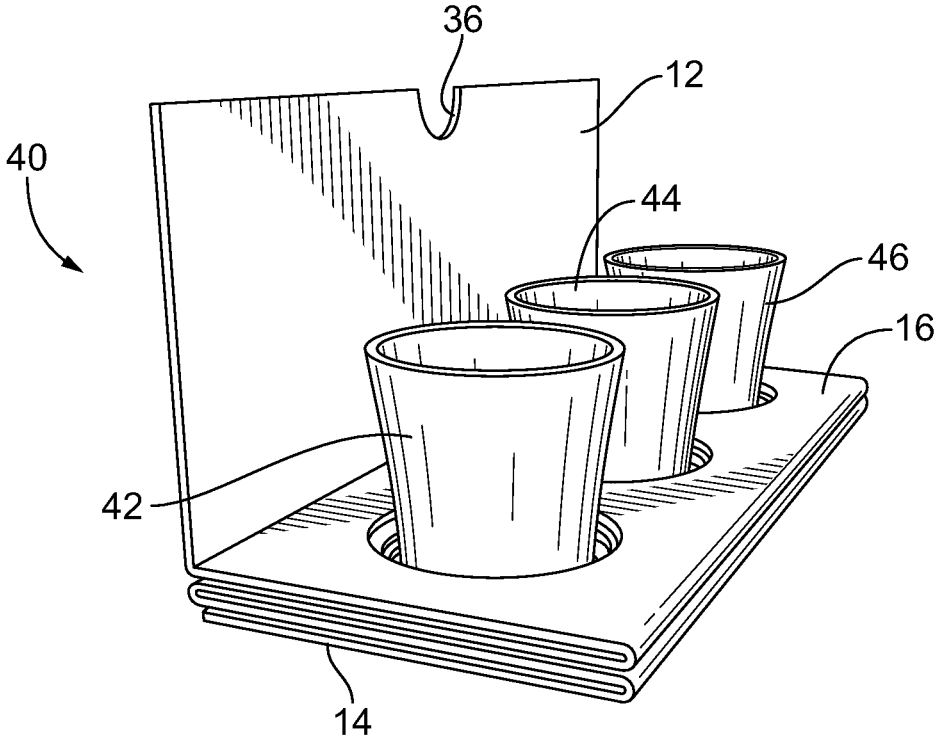
FIG. 2 is a perspective view of the corrugated accordion shaped insert in a compressed state with a plurality of products accommodated therein.

Referring now to the drawings, wherein like reference numerals identify similar structural elements of the subject invention, there is illustrated in FIG. 1 a die cut blank for forming an insert used to support and protect fragile products within a shipping container, which is designated generally by reference numeral 10.

The die cut blank 10 includes a plurality of rectangular panels which are foldably connected to one another along longitudinally extending edges. More particularly, the rectangular panels of the die cut blank 10 include an upper panel 12, a lower panel 14 and three successive medial panels 16, 18 and 20.

The upper panel 12 of blank 10 is foldably connected to the first medial panel 16 along a horizontal perforated crease 22, the first medial panel 16 is foldably connected to the second medial panel 18 along a horizontal perforated crease 24, the second medial panel 18 is foldably connected to the third medial panel 20 along a perforated crease 26, and the third medial panel 20 is foldably connected to the lower panel 14 along a horizontal perforated crease line 28.

Preferably, the die cut blank 10 is formed from a sheet of corrugated cardboard material having corrugations that run perpendicular to the horizontal creases or edges of the panels, and each panel is of equal width and length. Those skilled in the art will readily appreciate that the corrugations could run parallel to the horizontal creases or edges of the panels, and the size of the panels can vary depending upon the number and size of the products that are supported within the shipping container.

With continuing reference to FIG. 1, each medial panel 16, 18 and 20 of the blank 10 includes at least one aperture and preferably each medial panel of the blank includes a set of longitudinally spaced apart circular apertures. More preferably, the first medial panel 16 of blank 10 includes three equally sized longitudinally spaced apart circular apertures 30*a*, 30*b* and 30*c*, the second medial panel 18 of blank 10 includes three equally sized longitudinally spaced apart circular apertures 32*a*, 32*b* and 32*c*, and the third medial panel 20 of blank 10 includes three equally sized longitudinally spaced apart circular apertures 34*a*, 34*b* and 34*c*.

In a preferred embodiment of the subject invention, wherein the blank 10 is designed to form an insert to accommodate products that have a tapered outer diameter, the diameter $D_1$ of the longitudinally spaced apart apertures 30*a*, 30*b* and 30*c* in the first medial panel 16 of blank 10 is greater than the diameter $D_2$ of the longitudinally spaced apart apertures 32*a*, 32*b* and 32*c* in the second medial panel 18 of blank 10, and the diameter $D_2$ of the longitudinally spaced apart apertures 32*a*, 32*b* and 32*c* in the second medial panel 18 is greater than the diameter $D_3$ of the longitudinally spaced apart apertures 34*a*, 34*b* and 34*c* in the third medial panel 20 of blank 10. Thus, $D_1>D_2>D_3$.

Those skilled in the art will readily appreciate that the sets of longitudinally spaced apart apertures in each of the three medial panels 16, 18 and 20 of blank 10 could be of equal diameter so as to accommodate products that have a constant outer diameter, instead of a tapered outer diameter.

A semi-circular engagement notch 36 is formed in an upper longitudinal edge 38 of the upper panel 14 of blank 10 to enable a purchaser to lifting the upper panel 14 and access the products thereunder. Those skilled in the art will readily appreciate that the engagement notch 36 is an optional feature.

Figure 3:
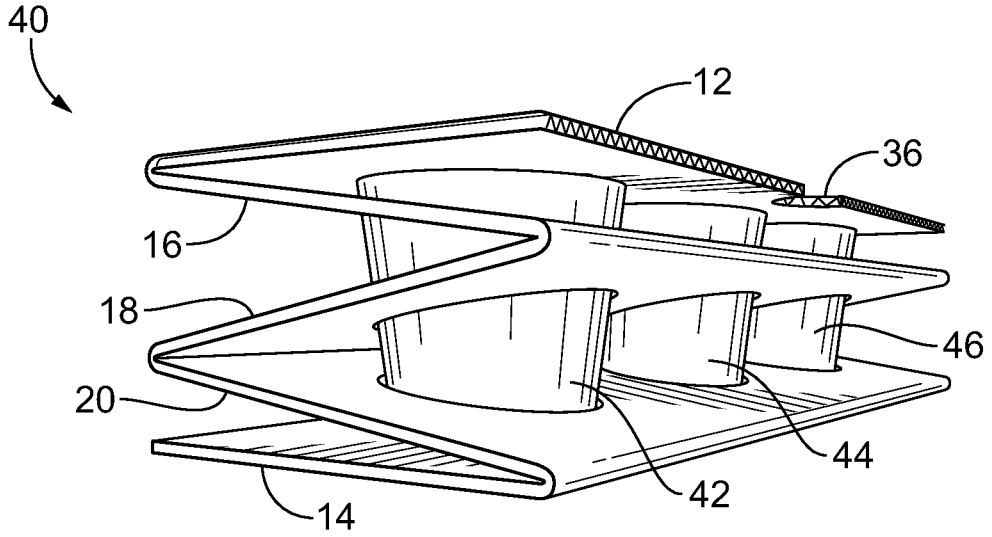
FIG. 3 is a perspective view of the corrugated accordion shaped insert in an expanded state with a plurality of products accommodated therein.

Referring FIG. 3, there is illustrated the accordion shaped insert 40 in a compressed state for receiving a set of products 42, 44 and 46, which have a tapered outer diameter. More particularly, the three medial panels 16, 18 and 20 are foldably compressed against the lower panel 14, so that apertures 30*a*, 32*a* and 34*a* are in axial alignment with each other, apertures 32*a*, 32*b* and 34*c* are in axial alignment with each other, and apertures 34*a*, 34*b* and 34*c* are in axial alignment with each other. At such a time, the upper panel 12 is folded away from the first medial panel 16 and the three identically shaped products 42, 44 and 46 can be loaded into the insert 40. The medial panels 16, 18 and 20 can then be moved into an expanded condition and the upper panel 14 can be folded over the top of the products, as shown in FIG. 3.

Figure 4:
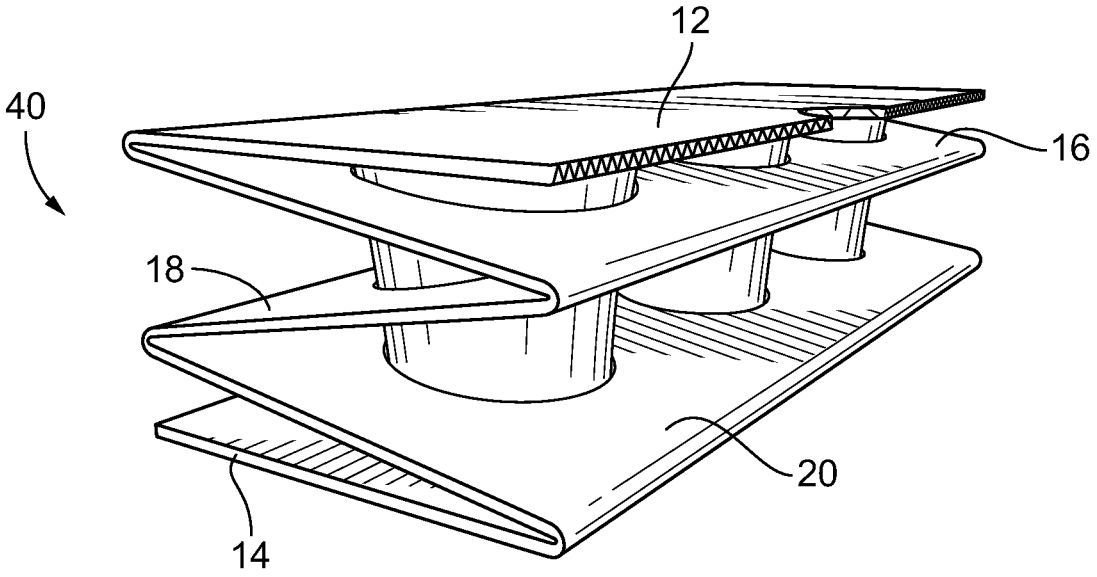
FIG. 4 is another perspective view of the corrugated accordion shaped insert in an expanded state with a plurality of products accommodated therein.
Figure 5:
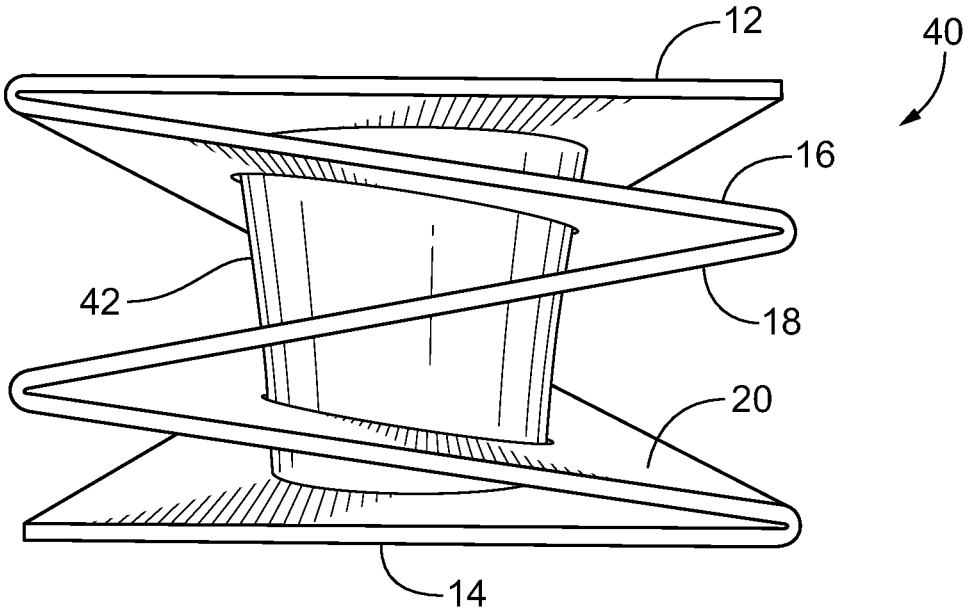
FIG. 5 is a side elevational view of the corrugated accordion shaped insert in an expanded state with a plurality of products accommodated therein.

Thereupon, the insert 40 assumes its accordion shaped configuration, which is further illustrated for clarity in FIGS. 4 and 5. At such a time, the three angled medial panels 16, 18 and 20 of insert 40 in their accordion configuration will provide a cushion curve on impact, reducing damage to the products supported therein.

Figure 6:
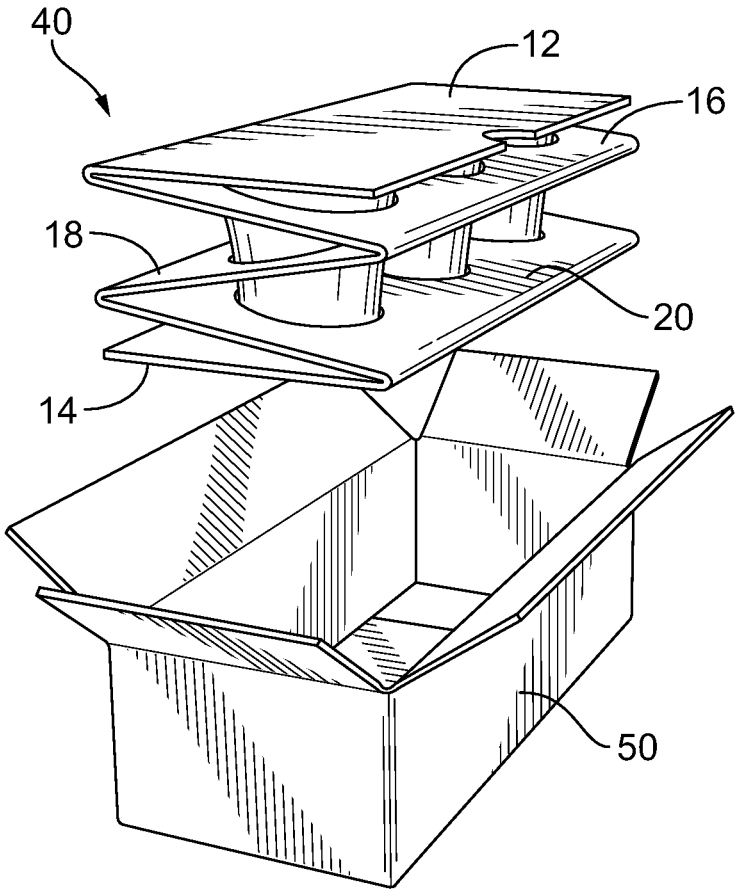
FIG. 6 is a perspective view of the corrugated accordion shaped insert in an expanded state with a plurality of products accommodated therein, as it is being loaded into a shipping container.
Figure 7:
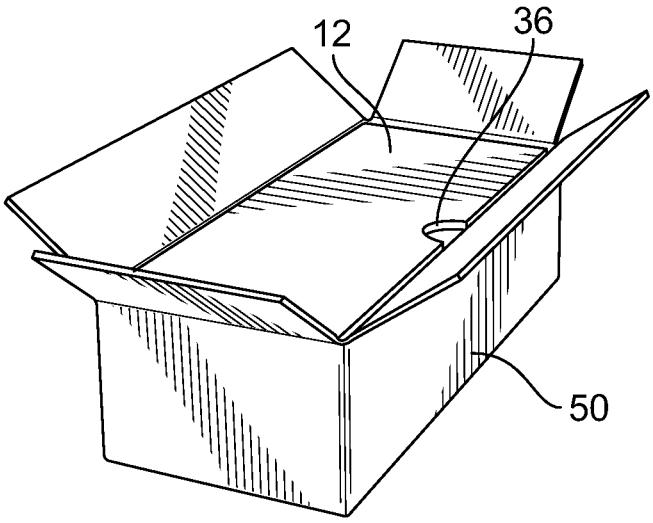
FIG. 7 is a perspective view of the corrugated accordion shaped insert in an expanded state with a plurality of products accommodated therein, loaded in the shipping container, with the top flaps of the container in an open condition for ease of illustration.

Once the accordion shaped insert 40 is filled with the products 42, 44 and 46, it can be top loaded into the interior space of a shipping carton 50, as best seen in FIG. 6. When the accordion shaped insert 40 is located within the shipping container 50 and the top and bottom flaps of the container 50 are closed, the upper panel 12 of the accordion shaped insert 40 will be in surface-to-surface planar contact with the top flaps of the shipping container 50, and the lower panel 14 of the accordion shaped insert 40 will be in surface-to-surface planar contact with the bottom flaps of the shipping container 50, as best illustrated in FIG. 7. Thereupon, the semi-circular engagement notch 36 in the upper panel 12 will be readily accessible when the top flaps of the container 50 are opened.

While the subject disclosure has been shown and described with reference to preferred embodiments, those skilled in the art will readily appreciate that changes or modifications may be made thereto without departing from the spirit or scope of the subject disclosure.

What is claimed is:

1. A product package, comprising:

a) a rectangular shipping container defining an interior space;

b) a corrugated insert installed within the interior space of the shipping container; and c) a plurality of products;

wherein the insert includes a plurality of rectangular panels foldably connected to one another along longitudinally extending edges thereof so as to form an accordion configuration that includes an upper panel, a lower panel and a plurality of medial panels, each medial panel having a set of longitudinally spaced apart circular apertures formed therein, wherein the apertures formed in each medial panel are aligned with the apertures formed in an adjacent medial panel to receive and support the plurality of products within the shipping container, wherein each medial panel is positioned at a non-zero angle with respect to each of two adjacent-most panels of the plurality of panels such that each medial panel is not disposed in face-contacting relationship with either of said two adjacent-most panels.

2. A product package as recited in claim 1, wherein the upper panel of the insert is positioned for surface to surface planar contact with a top panel of the shipping container.

3. A product package as recited in claim 1, wherein the lower panel of the insert is positioned for surface to surface planar contact with a bottom panel of the shipping container.

4. A product package as recited in claim 1, wherein the plurality of medial panels of the insert includes first, second and third medial panels.

5. A product package as recited in claim 1, wherein each medial panel of the insert includes three longitudinally spaced apart apertures.

6. A product package as recited in claim 1, wherein each aperture formed in the first medial panel of the insert has a diameter that is greater than a diameter of each aperture formed in the second medial panel of the insert, and each aperture formed in the second medial panel of the insert has a diameter that is greater than a diameter of each aperture formed in the third medial panel of the insert.

7. A product package as recited in claim 1, wherein the upper panel of the insert optionally includes an engagement notch formed in an outer longitudinal edge thereof to lift the upper panel away from the products supported by the insert.

* * * * *